US009027256B2

(12) United States Patent
Kim et al.

(10) Patent No.: US 9,027,256 B2
(45) Date of Patent: May 12, 2015

(54) LAUNDRY LINT FILTER CLEANING MACHINE

(71) Applicants: Youngsuk Kim, Seoul (KR); Junghoon Lee, Seoul (KR); Sangwook Hong, Seoul (KR)

(72) Inventors: Youngsuk Kim, Seoul (KR); Junghoon Lee, Seoul (KR); Sangwook Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 218 days.

(21) Appl. No.: 13/757,428

(22) Filed: Feb. 1, 2013

(65) Prior Publication Data

US 2013/0219734 A1 Aug. 29, 2013

(30) Foreign Application Priority Data

Feb. 29, 2012 (KR) ..... 10-2012-0020806

(51) Int. Cl.

| | |
|---|---|
| ***F26B 21/06*** | (2006.01) |
| ***D06F 58/04*** | (2006.01) |
| ***F26B 21/00*** | (2006.01) |
| ***D06F 58/22*** | (2006.01) |
| ***D06F 58/24*** | (2006.01) |
| ***D06F 25/00*** | (2006.01) |

(52) U.S. Cl.

CPC ..... *F26B 21/003* (2013.01); *D06F 58/22* (2013.01); *D06F 58/24* (2013.01); *D06F 25/00* (2013.01)

(58) Field of Classification Search

CPC ..... F26B 21/00; F26B 21/003; F26B 21/06; D06F 39/00; D06F 39/02; D06F 29/00; D06F 58/04

USPC ..... 34/82, 85, 595, 601, 606, 610; 68/5 R, 68/5 C, 19, 20; 8/138, 149, 158, 159

See application file for complete search history.

(56) References Cited

U.S. PATENT DOCUMENTS

| | | | | | |
|---|---|---|---|---|---|
| 1,731,290 | A | * | 10/1929 | Boltz | 34/608 |
| 2,387,407 | A | * | 10/1945 | Patch | 68/9 |
| 2,675,628 | A | * | 4/1954 | O'Neil | 34/75 |
| 2,686,372 | A | * | 8/1954 | Graham | 34/75 |
| 3,029,525 | A | * | 4/1962 | Pinder | 34/75 |
| 3,102,796 | A | * | 9/1963 | Erickson | 34/75 |
| 3,563,474 | A | * | 2/1971 | Robinson | 239/561 |
| 4,250,628 | A | * | 2/1981 | Smith et al. | 34/260 |
| 7,681,420 | B2 | * | 3/2010 | Jeong et al. | 68/20 |
| 7,882,647 | B2 | * | 2/2011 | Ikemizu | 34/524 |
| 7,926,201 | B2 | * | 4/2011 | Kim et al. | 34/524 |
| 7,987,616 | B2 | * | 8/2011 | Bae et al. | 34/601 |
| 7,997,006 | B2 | * | 8/2011 | Son et al. | 34/381 |

(Continued)

FOREIGN PATENT DOCUMENTS

| | | | |
|---|---|---|---|
| EP | 0648885 | A1 | 4/1995 |
| KR | 1020100091065 | A | 8/2010 |
| WO | 2010137910 | A2 | 12/2010 |

*Primary Examiner* — Steve M Gravini

(74) *Attorney, Agent, or Firm* — McKenna Long & Aldridge LLP

(57) ABSTRACT

The present invention relates to a laundry treating machine, including an air supply unit for supplying air, a tub for having the air supplied thereto from the air supply unit to treat the laundry, the tub having an air recovery opening formed in an outside circumferential surface thereof for recovery of the air to the air supply unit, a lint filter mounted to an inside of the air recovery opening for filtering the lint from the air, a filter cleaning unit for spraying cleaning water to separate the lint from the lint filter, and a flow passage member for guiding the cleaning water dropping from the lint filter to an inside of the tub to an inside surface of the tub.

11 Claims, 7 Drawing Sheets

(56) References Cited

U.S. PATENT DOCUMENTS

| | | | | |
|---|---|---|---|---|
| 8,800,165 | B2 * | 8/2014 | Kwon et al. | 34/595 |
| 2009/0151191 | A1 * | 6/2009 | Grunert | 34/480 |
| 2010/0146811 | A1 * | 6/2010 | Steffens | 34/480 |
| 2010/0154240 | A1 | 6/2010 | Grunert | |
| 2011/0277336 | A1 | 11/2011 | Shin et al. | |
| 2012/0017456 | A1 * | 1/2012 | Grunert | 34/82 |
| 2013/0219734 | A1 * | 8/2013 | Kim et al. | 34/82 |

* cited by examiner

- Prior art -

LAUNDRY LINT FILTER CLEANING MACHINE

CROSS REFERENCE TO RELATED APPLICATION

Pursuant to 35 U.S.C. §119(a), This application claims the benefit of the Patent Korean Application No. 10-2012-0020806, filed on Feb. 29, 2012, which is hereby incorporated by reference as if fully set forth herein.

BACKGROUND OF THE DISCLOSURE

1. Field of the Disclosure

The present invention relates to laundry treating machines, and more particularly, to a laundry treating machine in which cleaning water used for cleaning a lint filter which filters lint is used as cooling water for producing condensed water within a tub.

2. Discussion of the Related Art

In general, as examples of the laundry treating machine, there are washing machines, and drying and washing machines. The washing machine is a product for removing different kinds of dirt from clothes and beddings by using a softening action of detergent and a friction and an impact to the laundry of a water circulation caused by a pulsator or a drum. A full automatic washing machine appeared recently progresses a series of strokes of a washing course, a rinsing course, a spinning course, and so on without user's intervention.

And, the drying and washing machine is a kind of the washing machine which can perform functions of the washing machine described above as well as drying the laundry washed thus. In the drying and washing machine, there are condensing type drying and washing machines in which air drawn from the tub has moisture removed therefrom by water used for condensing, and is heated and introduced to the tub, again.

A related art condensing type drying and washing machine will be described with reference to FIG. 1, briefly. As shown, the drying and washing machine 10 is provided with a cabinet 11 which forms a space therein, a tub 12 housed in cabinet 11, a drum 13 rotatably mounted in the tub 12, a condensing duct 14 formed on an outside of the tub 12 for condensing moisture contained in the air from the tub 12, a heating duct 15 connected to downstream of the condensing duct 14 in a flow direction of the air for heating the air with a heater 16 and providing the air heated thus to an inside of the tub 12, and a fan 17 for making the air in the tub 12 to circulate along the condensing duct 14 and the heating duct 15.

In drying the laundry, the drying and washing machine 10 described thus dries the laundry with rotation of the drum and the air heated as the air is moved by the fan 17, heated by the heater 16 provided to the heating duct 15, and supplied to the inside of the tub 12.

Then, the heated air having the laundry dried thereby is turned to wet air as the heated air dries the laundry, introduced to the condensing duct 14 from the tub 12, and has the moisture removed therefrom at the condensing duct 14. In this case, the condensing duct 14 has cooling water supplied thereto separately for condensing the wet air. In the meantime, the air introduced to the condensing duct 14 is supplied to the heating duct 15 by the fan 17, again. Thus, the air is circulated by repeating above steps.

In the meantime, in drying the laundry by repeating above steps, the lint contained in the laundry is liable to be introduced through the condensing duct 14 together with the air, and remain at the condensing duct 14, the fan 17, and the heating duct 15. Consequently, a lint filter (Not shown) may be provided, for filtering the lint passing through the condensing duct 14, the fan 17, and the heating duct 15, additionally. However, there has been a problem in that the lint filtered at the lint filter in a course of drying acts as a resistor in an air circulating passage of the condensing duct 14, the fan 17, and the heating duct 15, causing a problem of making air circulating efficiency poor.

SUMMARY OF THE DISCLOSURE

An object of the present invention, devised to solve an above problem, is to provide a laundry treating machine in which a condensing structure which is provided for removing moisture from heated air having laundry dried thereby is improved for improving condensing efficiency.

Another object of the present invention, devised to solve an above problem, is to provide a laundry treating machine which has a lint filter for filtering lint from heated air.

And, another object of the present invention, devised to solve an above problem, is to provide a laundry treating machine having an improved repair and maintenance structure of a lint filter which filters lint from heated air.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry treating machine includes an air supply unit for supplying air, a tub for having the air supplied thereto from the air supply unit to treat the laundry, the tub having an air recovery opening formed in an outside circumferential surface thereof for recovery of the air to the air supply unit, a lint filter mounted to an inside of the air recovery opening for filtering the lint from the air, a filter cleaning unit for spraying cleaning water to separate the lint from the lint filter, and a flow passage member for guiding the cleaning water dropping from the lint filter to an inside of the tub to an inside surface of the tub.

It is preferable that the air supply unit is positioned on an upper side of the tub for supplying the air to a front of the tub, and circulating the air through the air recovery opening.

It is preferable that the air supply unit includes a fan positioned on an upper side of the air recovery opening for moving the air, a heating duct for heating the air being moved by the fan, and an air discharge hole for supplying the air heated at the heating duct to the front of the tub.

It is preferable that the tub has an inside circumferential surface of the tub used as a condensing surface for condensing moisture contained in the air.

It is preferable that the cleaning water sprayed from the filter cleaning unit is used as cooling water for cooling down the condensing surface of the tub.

It is preferable that the filter cleaning unit sprays the cleaning water from an outside of the lint filter to an inside of the tub.

It is preferable that the filter cleaning unit includes a cleaning water line for supplying the cleaning water, and a distribution nozzle unit for spraying the cleaning water being supplied from the cleaning water line.

It is preferable that the flow passage member is positioned on a lower side of the lint filter for closing a portion of a filtering area of the lint filter.

It is preferable that the flow passage member is formed on a downstream side of the cleaning water flowing along the lint filter.

It is preferable that the flow passage member includes a mounting wall to be fastened to the air recovery opening from a lower side of the lint filter, a guide plate formed on an underside of the mounting wall to form a moving passage of the cleaning water, and a flow out hole for flow out of the cleaning water guided by the guide plate to the inside circumferential surface of the tub.

It is preferable that the laundry treating machine further includes an extension plate extended along an inside surface of the tub from a lower side of the guide plate for guiding the cleaning water to the inside surface of the tub.

It is preferable that the extension plate includes one pair of mounting portions projected from both sides in a flow direction of the cleaning water, for fastening to the inside surface of the tub, and a flow passage groove recessed between the mounting portions to form a flow passage.

It is preferable that the lint filter includes a filter frame formed in conformity with an inside shape of the air recovery opening to have a space for flow of the air, and a filter provided to the space in the filter frame for filtering the lint.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts.

In describing the present invention, terms of elements defined herein have been defined taking functions thereof in the present invention into account. Therefore, it is required that the terms are not to be understood in a sense that the terms limit technical elements of the present invention. And, the terms of the elements defined thus may be called in other terms in this field of art.

A laundry treating machine in accordance with a preferred embodiment of the present invention will be described with reference to the attached drawings, in detail.

A laundry treating machine in accordance with a preferred embodiment of the present invention will be described with reference to the attached drawings, briefly.

Figure 1:
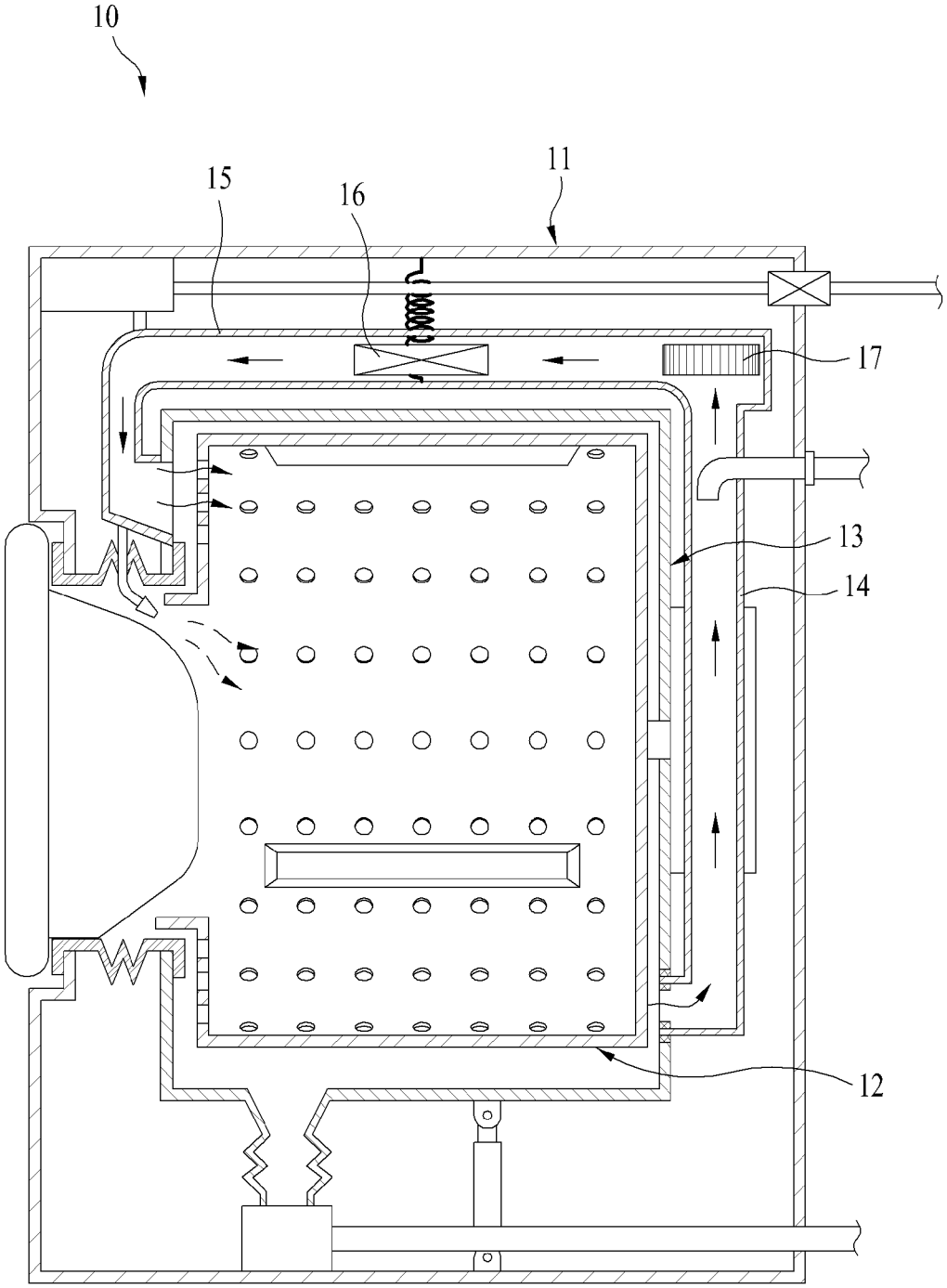
FIG. 1 illustrates a longitudinal section of a related art condensing type drying and laundry treating machine.
Figure 2:
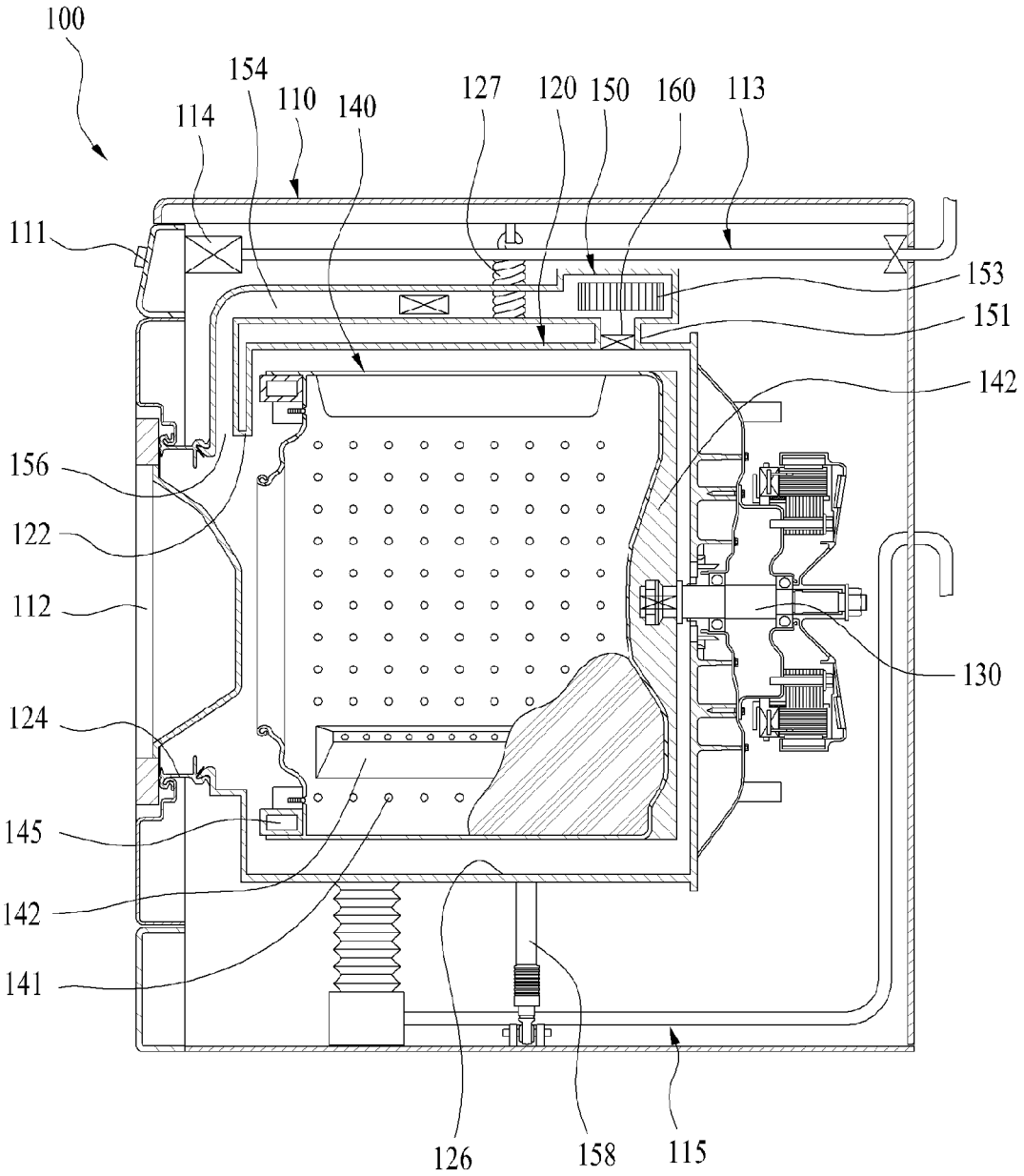
FIG. 2 illustrates a schematic view of an inside structure of a laundry treating machine of the present invention.
Figure 3:
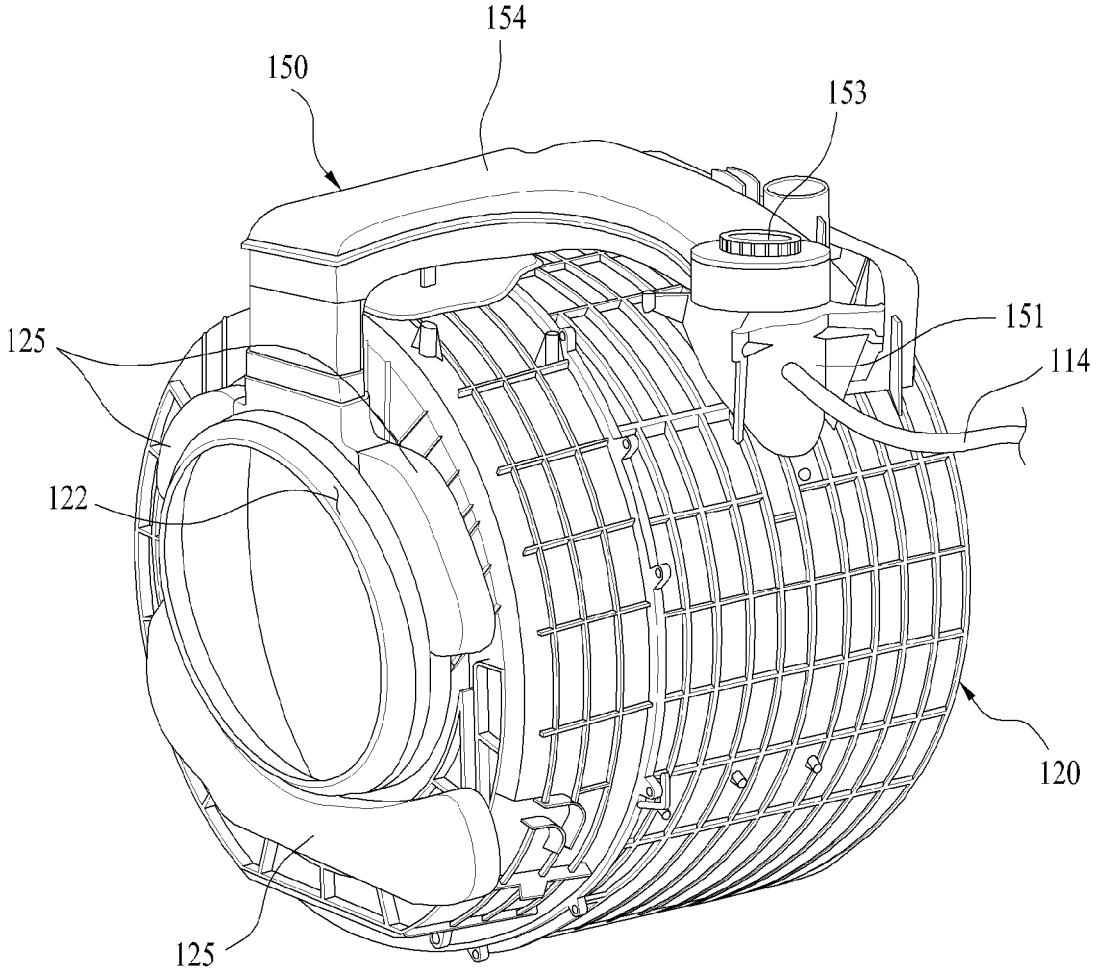
FIG. 3 illustrates a perspective view showing key parts of a laundry treating machine of the present invention.

FIG. 2 illustrates a schematic view of an inside structure of a laundry treating machine of the present invention, and FIG. 3 illustrates a perspective view showing key parts of a laundry treating machine of the present invention.

Referring to FIGS. 2 and 3, the laundry treating machine includes a cabinet 110 which forms an exterior appearance of the laundry treating machine, a tub 120 provided in the cabinet 110 for holding washing water, a drum 140 provided in the tub 120 to be rotatable in an axis direction, a driving motor 130 for giving rotating force to the drum 140 to wash, rinse, or spin laundry introduced to the drum 140, an air supply unit 150 for supplying heated air to the tub 120 to dry the laundry 1, a control unit (Not shown) for controlling respective elements to operate the laundry treating machine 100, and an operation panel 111 for controlling respective elements in association with the control unit.

The cabinet 110 forms an exterior appearance of the laundry treating machine 100 of the embodiment, and has various elements to be described later mounted to an outside or an inside thereof. The cabinet 110 has a door 112 rotatably mounted to a front thereof.

And, provided to an upper side of an inside of the cabinet 110, there is a water supply unit 113 including a water supply hose for supplying water to an inside of the tub 120 from an external water source, a water supply valve mounted to the water supply hose for controlling water supply, and a detergent supply unit 114 for introducing detergent thereto such that the water supplied through the water supply hose is introduced to the inside of the tub 120 together with the detergent.

And, provided to a lower side of the inside of the cabinet 110, there is a drain unit 115 having a drain hose and a drain pump for draining the washing water used for washing and rinsing to an outside of the laundry treating machine.

The tub 120 is provided in the cabinet 110 to hold the washing water, and has a shape of a container opened toward a door 112 side for receiving the laundry 1 introduced through the door 112.

In this case, the tub 120 has an opened portion formed in a front thereof for introducing the laundry 1 thereto. There is a weight 125 attached to an outside of the opened portion for increasing a weight of the tub 120 to prevent vibration from taking place. And, the opened portion has a rim portion 122 projected from an inside circumference thereof toward a front of the tub 120. The rim portion 122 has an air discharge hole 156 of the air supply unit 150 to be described later connected thereto. In the meantime, the tub 120 has an air recovery opening 151 of the air supply unit 150 to be described later formed in an outside circumference thereof.

And, mounted to a rear of the tub 120, there is a driving motor 130 for rotating the drum 140. The control unit controls a rotation speed of the driving motor 130. Since structures and kinds of the driving motor 130 are known to persons in this field of art, and may have many variations, detailed description thereof will be omitted.

The laundry treating machine 100 of the present invention has an inside circumferential surface of the tub 120 formed to be used as a condensing surface 126 for forming condensed water. According to this, a structure of a condensing duct in the related art for condensing the moisture in wet air having the laundry 1 dried thereby is omitted. A process for producing the condensing water changed according to the omission of the condensing duct will be described in description of the air supply unit 150 and in description of operation of the laundry treating machine 100, in detail.

In the meantime, the tub 120 is supported by springs 17 on the upper side and dampers 128 on a lower side thereof, elastically. According to this, the springs 127 and the dampers 128 attenuate vibration generated when the drum is rotated by the driving motor 130 and transmitted through the tub 120, thereby reducing transmission of the vibration caused by the rotation of the drum 140.

The drum 140 is rotatably provided to an inside of the tub 120, and the laundry 1 introduced through the door 112 is held in the drum 140. The drum 140 has a plurality of water extraction holes 141 formed therein for passing through of the washing water, and a plurality of lifts 142 formed on an inside of the drum 140 for loading the laundry 1 thereon, lifting, and dropping the laundry 1 in the drum 140 when the drum 140 rotates, to improve a washing performance.

And, mounted on a front and a rear of the drum 140, there are balancers 145 to compensate for unbalance caused by the laundry 1 when the drum 140 rotates. Provided in rear of the drum 140, there are a rotation shaft 144 connected to the driving motor 130, and a spider 143 connected to the rotation shaft 144.

The air supply unit 150 is provided to the upper side of the tub 120 for circulating and heating the air in the tub 120 in the drying stroke. That is, the air supply unit 150 is configured to draw the air from the inside of the tub 120, heat the air, and introduce to the tub 120, again.

The air supply unit 150 includes an air recovery opening 151 formed in a side of an outside circumferential surface of the tub 120, a fan 153 for recovery of the air through the air recovery opening 151 and making the air to move, a heating duct 154 for heating the air being moved by the fan 153, and an air discharge hole 156 for guiding the air heated at the heating duct 154 to the tub 120.

In this case, the air recovery opening 151 is formed to pass through the side of the outside circumferential surface of the tub 120. And, the air recovery opening 151 has a lint filter 160 provided to an inside surface thereof along the outside circumferential surface of the tub 120 for filtering the lint produced when the laundry 1 is dried.

In this case, the lint filter 160 is provided to an inside of the air recovery opening 151 to be inserted therein, detachably. For this, the lint filter 160 has a filter frame 161 having a space for flow of the air therethrough formed in conformity with an inside shape of the air recovery opening 151, and a filter 162 provided to the air flow space of the filter frame 161 for filtering the lint. In this case, it is preferable that the filter 162 has a predetermined curve so as to be extended along a curved shape of an inside circumference of the tub 120.

In the meantime, provided over the lint filter 160 in the air recovery opening 151, there is a filter cleaning unit 170 (See FIG. 4) for removing the lint filtered at the lint filter 160. The filter cleaning unit 170 will be described later with reference to the drawing, in detail.

And, the fan 153 is provided over the air recovery opening 151. As the fan 153 operates, the air is drawn from the inside of the tub 120 and discharged toward the heating duct 154. In the meantime, the heating duct 154 heats the air being moved by the fan 153 to produce heated air. The air heated in the heating duct 154 is supplied to the inside of the tub 120 through the air discharge hole 156, to dry the laundry 1.

In the meantime, in the air supply unit 150 described thus, the lint filter 160 that filters lint from the air introduced to the air recovery opening 151 requires maintenance for removing the lint filtered thus when the lint filter 160 is used for a long time period.

For this, provided to the inside of the air recovery opening 151, there is a filter cleaning unit 170 (See FIG. 4) for removing the lint filtered at the lint filter 160 by spraying cleaning water toward the lint filter 160. In this case, the filter cleaning unit 170 has water supply thereto controlled by a separate cleaning water valve (Not shown) at the water supply unit 113 which supplies washing water for washing the laundry.

Figure 4:
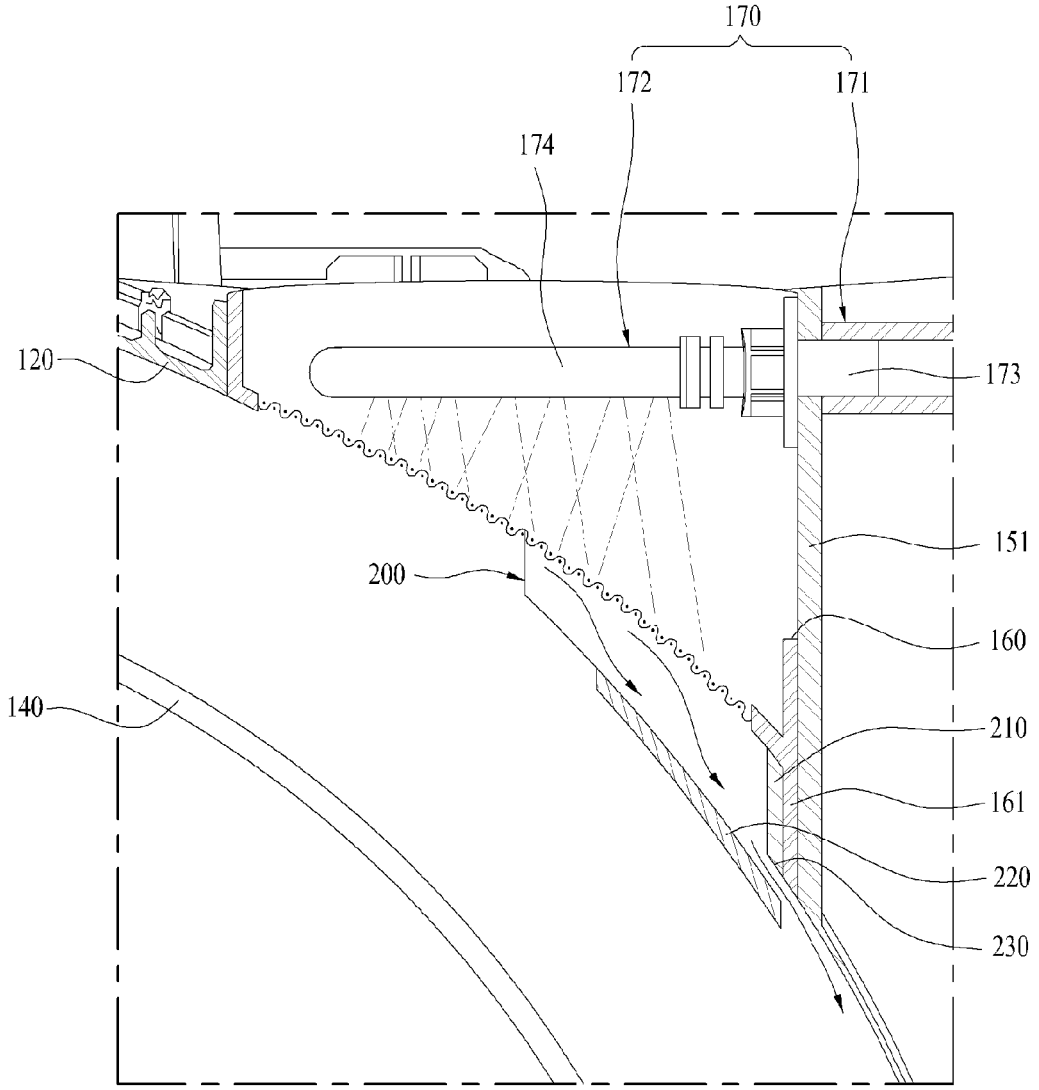
FIG. 4 illustrates a transverse section showing an air recovery opening and a filter cleaning unit in accordance with a preferred embodiment of the present invention.

The air recovery opening and the filter cleaning unit will be described with reference to the drawings, in detail. FIG. 4 illustrates a transverse section showing an air recovery opening and a filter cleaning unit in accordance with a preferred embodiment of the present invention.

Referring to FIG. 4, provided to the inside of the air recovery opening 151, there are the lint filter 160 for filtering the lint produced when the heated air is supplied and circulated for drying the laundry, and the filter cleaning unit 170 for spraying the cleaning water from an outside to an inside of the lint filter 160 to drop the lint from the lint filter 160 to the inside of the tub 120.

In this case, the filter cleaning unit 170 includes a cleaning water line 171 for supplying the cleaning water, and a distribution nozzle unit 172 secured to the inside of the air recovery opening 151 passed through the air recovery opening 151 and connected to the cleaning water line 171 on an outside of the air recovery opening 151.

The cleaning water line 171 is configured to supply the cleaning water separate from the washing water supply with a cleaning water valve (Not shown) provided separate from the washing water supply of the water supply unit 113. Since the configuration of the cleaning water line 171 may have numerous variations, detailed description thereof will be omitted.

The distribution nozzle unit 172 is provided to be secured to the inside of the air recovery opening 151 and connected to the cleaning water line 171 for having the cleaning water supplied thereto through the cleaning water line 171 and spraying the cleaning water to an upper side of the filter of the lint filter 160.

The distribution nozzle unit 172 includes a fastening portion 173 detachably secured to the air recovery opening 151 connected to the cleaning water line, and a nozzle portion 174 extended to the inside of the air recovery opening 151 coupled to the fastening portion 173 having a plurality of nozzles (Not shown) formed therein for spraying the cleaning water toward a lower side from a top side of the lint filter 160. In this case, the fastening portion 173, and the nozzle portion 174 have hollows for pass through of the cleaning water. Since the distribution nozzle unit 172 may have numerous variations, detailed description thereof will be omitted.

In the meantime, the air recovery opening 151 has one side having a fastening hole (Not shown) or a fastening recess (Not shown) formed therein for having the fastening portion 173 of the distribution nozzle unit 172 coupled thereto. In this case, the fastening hole or the fastening recess may be a holding step or a thread for securing the fastening portion of the distribution nozzle unit 172 thereto. Since a fastening structure of the fastening hole or the fastening recess may have numerous variations, detailed description thereof will be omitted.

In the meantime, in the filter cleaning unit 170 described above, the cleaning water sprayed to the lint filter 160 for cleaning the filter serves, not only separating/removing the lint filtered from the lint filter 160, but also flows down along an inside circumferential surface of the lint filter 160, and, therefrom, to an inside circumferential surface (i.e., a condensing surface) of the tub 120 to cool down the inside circumferential surface of the tub 120.

In this case, as the inside circumferential surface of the tub 120 is cooled down by the filter cleaning water, the moisture contained in the air having the laundry dried thereby in the tub 120 is condensed as the moisture comes into contact with the inside surface of the tub 120, to turn the air into relatively dry air.

In the meantime, the tub 120 of the present invention has high temperature and humid air staying therein, and air with a temperature lower than the inside of the tub 120 staying on an outside thereof. Therefore, even if no cleaning water is supplied from the filter cleaning unit 170 as described before, the condensing at the inside circumferential surface of the tub 120 can take place owing to a temperature difference between the inside and outside temperatures of the tub 120. Even in this case too, a condensing rate of the present invention can be larger than a condensing rate with the condensing duct in the related art.

That is, the condensing duct in the related art induces the condensing with an area smaller than the inside circumferential surface of the tub 120. However, if the condensing is induced by the inside circumferential surface of the tub 120 like the present invention, an area of cooling for the condensing increases larger than the condensing duct, relatively. Therefore, since the laundry treating machine of the present invention has a larger condensing surface 126 than the related art which uses the condensing duct, condensing efficiency can be increased.

In the meantime, the filter cleaning unit 170 in accordance with a preferred embodiment of the present invention is provided for spraying the cleaning water at a predetermined pressure in a direction from the outside to the inside of the lint filter 160 to drop the lint to the inside of the tub 120 from the lint filter 160. And, as described before, it is also possible to induce that the condensed water having the lint removed thereby as described before is made to flow the inside circumferential surface of the tub 120 to cool down the inside circumferential surface of the tub 120.

In the meantime, the filter cleaning unit 170 described before provided to the inside of the air recovery opening 151 sprays the cleaning water to the inside direction of the tub 120 for cleaning the lint filter 160. In this case, most of the cleaning water flows to a lower side of the lint filter 160 along the lint filter 160. However, there may be case in which a portion of the cleaning water passes through the lint filter 160 and drops and introduced to an inside of the tub 120.

In this case, the cleaning water and the lint separated from the lint filter 160 by the cleaning water may be introduced to an inside of the drum 140 to contaminate the washed laundry, again. And, since the cleaning water having the lint 160 cleaned thereby fails to be used as means for cooling down the inside circumferential surface (i.e., the condensing surface) of the tub 120, the condensing efficiency may become poor.

To deal with this, a flow passage member 200 or 300 is provided on an underside of the lint filter 160 for preventing the cleaning water sprayed for removal of the lint from dropping down and introduced to the tub 120 directly, and guiding the cleaning water dropped from the lint filter 160 and being introduced to the tub 120 to an inside wall side of the tub 120.

Figure 5:
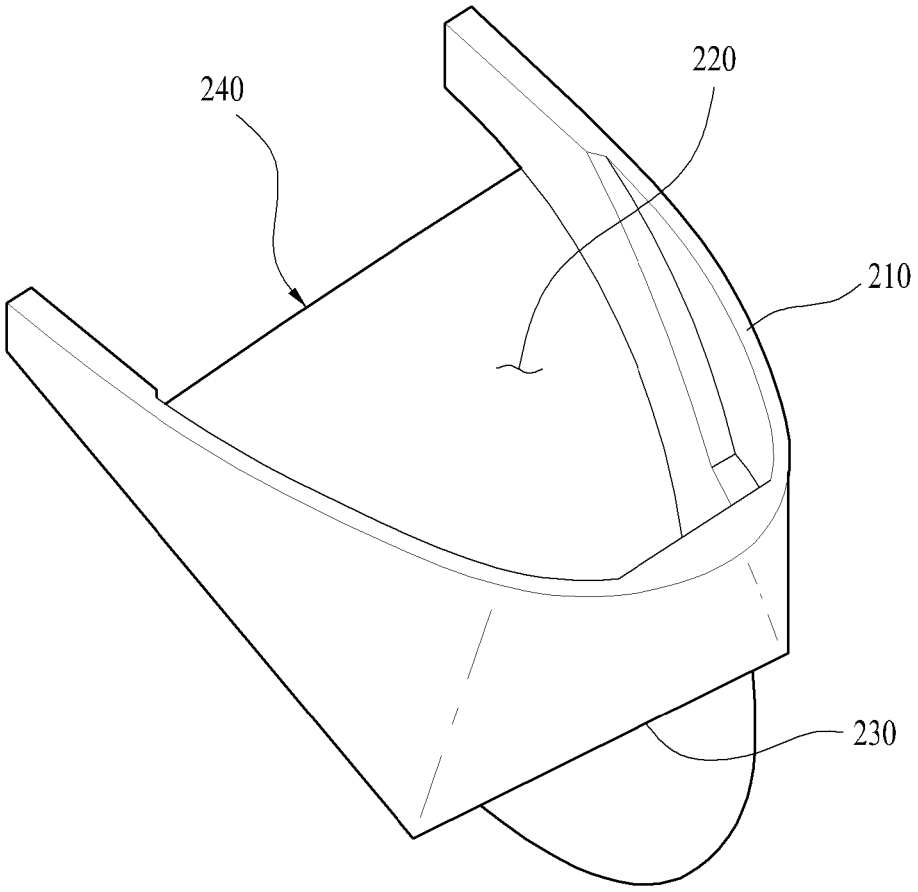
FIG. 5 illustrates a perspective view of a flow passage member in accordance with a preferred embodiment of the present invention.

The flow passage member 200 in accordance with a preferred embodiment of the present invention will be described, with reference to FIG. 5. FIG. 5 illustrates a perspective view of a flow passage member in accordance with a preferred embodiment of the present invention.

Referring to FIGS. 4 and 5, there is a flow passage member 200 detachably mounted to a lower side (More specifically, to an underside of the lint filter 160 mounted to the air recovery opening 151) of the inside of the air recovery opening 151.

The flow passage member 200 is placed from the inside of the tub 120 to an outside direction of the air recovery opening 151 and fastened to the air recovery opening 151. For this, the lint filter 160 is mounted to the air recovery opening 151, with the lint filter 160 placed to an inner side of the air recovery opening 151 further by a predetermined distance. That is, a filter surface of the lint filter 160 is mounted to the air recovery opening 151, with the filter surface moved to an outer side of the tub 120 further from an extension line of the inside circumferential surface of the tub 120. In this case, the flow passage member 200 is detachably fastened to a space formed between the extension line from the inside circumferential surface of the tub 120 and the lint filter 160.

In the meantime, the flow passage member 200 includes a mounting wall 210 in contact with, and fastened to, the inside circumferential surface of the air recovery opening 151 from the inside of the tub 120, and a guide plate 220 provided to an underside of the mounting wall 210 to close a portion of the mounting wall 210 (In other words, a portion of the air recovery opening 151 or the lint filter 160) for forming a passage of the cleaning water dropping from the lint filter 160 to move toward the inside circumferential surface (the condensing surface) of the tub.

In this case, the mounting wall 210 is formed to have a shape in conformity with a shape of the inside circumferential surface of a lower side of the air recovery opening 151, and, may have a holding projection (Not shown) or a holding structure (Not shown) additionally for easy attachment/detachment. Moreover, though the mounting wall 210 may be formed to have a ring shape with a predetermined height in conformity with a shape of the inside circumferential surface of the air recovery opening 151, the mounting wall 210 may have a portion thereof cut opened so that the mounting wall 210 has an elastic force in an outer direction for fastening the flow passage member 200 to the air recovery opening 151 by pressing the inside circumferential surface of the air recovery opening 151 with predetermined elastic force.

And, there is a flow out hole 230 formed between the mounting wall 210 and the guide plate 220 for making the cleaning water dropped from the lint filter 160 to flow toward the inside circumferential surface of the tub 120. It is preferable that the flow out hole 230 is formed adjacent to the inside circumferential surface of the tub 120. And, the guide plate 220 which forms a bottom of the flow out hole 230 may be formed to extend toward the inside circumferential surface of the tub 120 further for guiding the cleaning water being flowing out.

The operation of the flow passage member 200 in accordance with a preferred embodiment of the present invention will be described.

In a case of the laundry treating machine 100 of the present invention, the filter cleaning unit 170 may be operated for cleaning the lint filter 160 during the washing stroke, the spinning stroke, or the drying stroke. However, it is preferable that the filter cleaning unit 170 is operated in the drying stroke when most of the lint is filtered at the lint filter 160.

In the meantime, the operation process of the filter cleaning unit 170 is as follows. If the cleaning of the lint filter 160 is performed by the filter cleaning unit 170, the cleaning water is supplied through the cleaning water line 171 for cleaning the lint filter 160, and the cleaning water is sprayed to the lint filter 160 through the distribution nozzle unit 172 of the filter cleaning unit 170 to separate the lint from the lint filter 160, thereby cleaning the lint filter 160.

In the meantime, the cleaning water, sprayed to the lint filter 160 to clean and separate the lint from the lint filter 160, flows down along the inside circumferential surface of the tub 120 together with the lint separated thus and drained to an outside of the laundry treating machine 100 through the drain unit 115 formed under the tub 120.

In this case, the cleaning water dropping to the inside of the tub from the filter 162 of the lint filter 160 drops onto the guide plate 220 of the flow passage member 200, and, therefrom, is drained to the flow out hole 230 along a flow passage constructed of the guide plate 220 and the mounting wall 210. According to this, the cleaning water flows out of the flow out hole 230 to the inside circumferential surface of the tub owing to the guide plate, so as to be drained while cooling down the inside surface of the tub 120. Eventually, by cooling the inside surface of the tub 120, the cleaning water makes the inside surface of the tub 120 to serve as the condensing surface 126.

Figure 6:
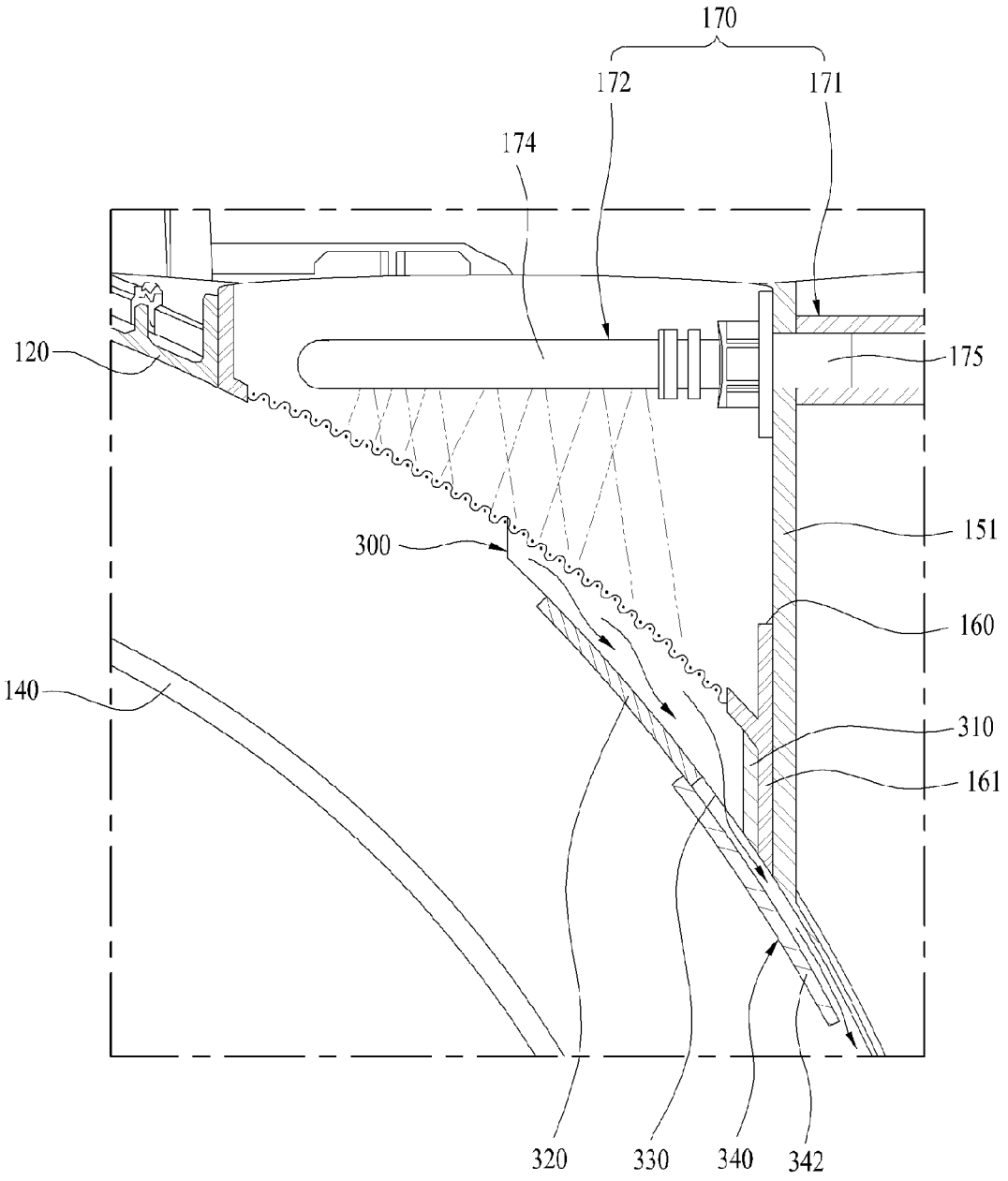
FIG. 6 illustrates a transverse section showing an air recovery opening and a filter cleaning unit in accordance with another preferred embodiment of the present invention.

A flow passage member in accordance with another preferred embodiment of the present invention will be described, with reference to FIGS. 6 and 7. FIG. 6 illustrates a transverse section showing an air recovery opening and a filter cleaning unit in accordance with another preferred embodiment of the present invention, and FIG. 7 illustrates a perspective view of a flow passage member in accordance with another preferred embodiment of the present invention.

Figure 7:
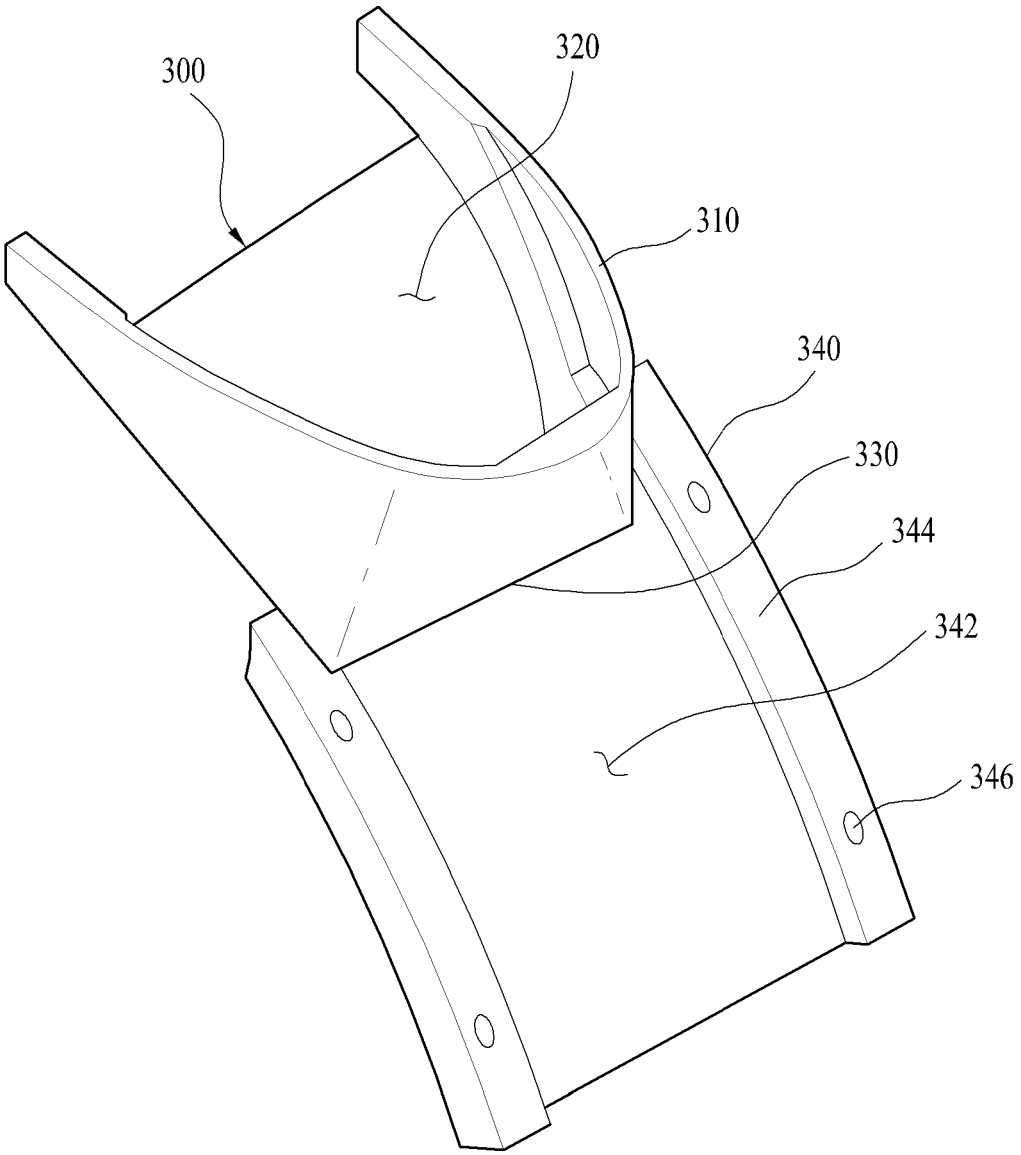
FIG. 7 illustrates a perspective view of a flow passage member in accordance with another preferred embodiment of the present invention.

Referring to FIGS. 6 and 7, there is a flow passage member 300 detachably mounted to a lower side (More specifically, to an underside of the lint filter 160 mounted to the air recovery opening 151) of the inside of the air recovery opening 151.

Alike the foregoing embodiment, the flow passage member 300 is placed from the inside of the tub 120 to an outside direction of the air recovery opening 151 and fastened to the air recovery opening 151. The flow passage member has a structure the same with the foregoing embodiment, and detailed description thereof will be omitted.

In the meantime, the flow passage member 300 includes a mounting wall 310 in contact with, and fastened to, the inside circumferential surface of the air recovery opening 151 from the inside of the tub 120, a guide plate 320 provided to an underside of the mounting wall 310 to close a portion of the mounting wall 310 (In other words, a portion of the air recovery opening 151 or the lint filter 160) for forming a passage of the cleaning water dropping from the lint filter 160 to move toward the inside circumferential surface (the condensing surface) of the tub, and an extension plate 340 for guiding the cleaning water flowed down on the guide plate 320 to flow close to the inside surface of the tub 120, further.

In this case, the mounting wall 310 is formed to have a shape in conformity with a shape of the inside circumferential surface of a lower side of the air recovery opening 151, and, may have a holding projection (Not shown) or a holding structure (Not shown) additionally for easy attachment/detachment. Moreover, though the mounting wall 310 may be formed to have a ring shape with a predetermined height in conformity with a shape of the inside circumferential surface of the air recovery opening 151, the mounting wall 310 may have a portion thereof cut opened so that the mounting wall 310 has an elastic force in an outer direction for fastening the flow passage member 300 to the air recovery opening 151 by pressing the inside circumferential surface of the air recovery opening 151 with predetermined elastic force.

And, there is a flow out hole 330 formed between the mounting wall 310 and the guide plate 320 for making the cleaning water dropped from the lint filter 160 to flow toward the inside circumferential surface of the tub 120. It is preferable that the flow out hole 330 is formed adjacent to the inside circumferential surface of the tub 120.

In the meantime, the extension plate 340 is positioned on a lower side of the flow out hole 330 secured to the tub 120 from an inside of the tub 120 to form a flow passage of the cleaning water flowing down from the flow out hole 330. The extension plate 340 is a plate with a predetermined width, with mounting portions 344 formed on, and projected from, both sides of a moving direction of the cleaning water of the extension plate 340 for fastening the extension plate 340 to the tub 120. The mounting portions 344 have a plurality of mounting holes 346 at predetermined portions thereof for fastening the extension plate 340 to the tub 120 with separate fastening members (For an example, bolts or the like). And, a flow passage groove 342 is formed between both of the mounting portions 344 recessed from the mounting portions 344 to form a flow passage of the cleaning water. In this case, it is preferable that the extension plate 340 is formed to be extended with a curve in conformity with a curve of the inside circumferential surface of the tub 120.

The operation of the flow passage member 300 in accordance with another preferred embodiment of the present invention will be described.

The flow member 300 in accordance with another preferred embodiment of the present invention has a function identical to the flow passage member 200 described in the foregoing embodiment. Therefore, detailed description of operation identical to the foregoing embodiment will be omitted, while description of the operation different from the foregoing embodiment will be described, in detail.

In the meantime, if the cleaning of the lint filter is performed by the filter cleaning unit 170, the cleaning water having the lint cleaned and separated from the filter thereby flows down along the inside circumferential surface of the tub 120 together with the lint separated thus, and drained to an outside of the laundry treating machine 100 through the drain unit 115 formed under the tub 120.

In this case, the cleaning water dropping to the inside of the tub from the filter 162 of the lint filter 160 drops onto the guide plate 320 of the flow passage member 300, and, therefrom, is drained to the flow out hole 330 along a flow passage constructed of the guide plate 320 and the mounting wall 310.

And, the cleaning water drained from the flow out hole 330 flows to the extension plate 340 positioned on a lower side of the flow out hole 330, flows down along a space between the extension plate 340 and the tub, and drained while cooling down the inside surface of the tub 120. Eventually, by cooling down the inside surface of the tub 120, the cleaning water makes the inside surface of the tub 120 to serve as the condensing surface 126.

As has been described, the laundry treating machine of the present invention can improve condensing efficiency and prevent cooling water from wasting by making the inside surface of the tub to serve as a condensing surface for removing moisture from the heated air having the laundry dried thereby, thereby providing a larger condensing area than the condensing structure in the related art.

And, the lint filter provided to the extension plate 340 of the present invention for filtering the lint from the air circulating after drying the laundry can prevent the laundry treating machine from going out of order due to the lint.

And, the filter cleaning structure provided for maintenance of the lint filter which filters the lint from the air circulating after drying the laundry permits easy cleaning of the lint filter.

And, since the cleaning water sprayed to the filter for removing the lint from the lint filter is made to flow down along the inside circumferential surface of the tub to bring about a tub cooling effect, the laundry treating machine of the present invention permits to improve condensing efficiency utilizing the inside surface of the tub.

The improvement of the condensing structure which is provided for removing moisture from the heated air having the laundry dried thereby permits to improve the condensing efficiency of the moisture contained in the heated air.

And, the laundry treating machine of the present invention permits to prevent the laundry treating machine from going out of order due to the lint by providing the lint filter which filters the lint from the circulating air.

And, the laundry treating machine of the present invention permits to clean the lint filter easily by providing a filter cleaning structure for maintenance of the lint filter which filters the lint from the circulating air.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A laundry treating machine comprising:

an air supply unit for supplying air;

a tub for having the air supplied thereto from the air supply unit to treat the laundry, the tub having an air recovery opening formed in an outside circumferential surface thereof for recovery of the air to the air supply unit;

a lint filter mounted to an inside of the air recovery opening for filtering the lint from the air;

a filter cleaning unit for spraying cleaning water to separate the lint from the lint filter; and a flow passage member for guiding the cleaning water dropping from the lint filter to an inside of the tub to an inside surface of the tub, wherein the air supply unit is positioned on an upper side of the tub for supplying the air to a front of the tub, and circulating the air through the air recovery opening, and includes a fan positioned on an upper side of the air recovery opening for moving the air, a heating duct for heating the air being moved by the fan, and an air discharge hole for supplying the air heated at the heating duct to the front of the tub.

2. The laundry treating machine as claimed in claim 1, wherein the tub has an inside circumferential surface of the tub used as a condensing surface for condensing moisture contained in the air.

3. The laundry treating machine as claimed in claim 2, wherein the cleaning water sprayed from the filter cleaning unit is used as cooling water for cooling down the condensing surface of the tub.

4. The laundry treating machine as claimed in claim 1, wherein the filter cleaning unit sprays the cleaning water from an outside of the lint filter to an inside of the tub.

5. The laundry treating machine as claimed in claim 1, wherein the filter cleaning unit includes;

a cleaning water line for supplying the cleaning water, and a distribution nozzle unit for spraying the cleaning water being supplied from the cleaning water line.

6. The laundry treating machine as claimed in claim 1, wherein the flow passage member is positioned on a lower side of the lint filter for closing a portion of a filtering area of the lint filter.

7. The laundry treating machine as claimed in claim 1, wherein the flow passage member is formed on a downstream side of the cleaning water flowing along the lint filter.

8. The laundry treating machine as claimed in claim 1, wherein the flow passage member includes;

a mounting wall to be fastened to the air recovery opening from a lower side of the lint filter, a guide plate formed on an underside of the mounting wall to form a moving passage of the cleaning water, and a flow out hole for flow out of the cleaning water guided by the guide plate to the inside circumferential surface of the tub.

9. The laundry treating machine as claimed in claim 8, further comprising an extension plate extended along an inside surface of the tub from a lower side of the guide plate for guiding the cleaning water to the inside surface of the tub.

10. The laundry treating machine as claimed in claim 9, wherein the extension plate includes;

one pair of mounting portions projected from both sides in a flow direction of the cleaning water, for fastening to the inside surface of the tub, and a flow passage groove recessed between the mounting portions to form a flow passage.

11. The laundry treating machine as claimed in claim 1, wherein the lint filter includes;

a filter frame formed in conformity with an inside shape of the air recovery opening to have a space for flow of the air, and a filter provided to the space in the filter frame for filtering the lint.

* * * * *